US006170476B1

(12) United States Patent
Cook et al.

(10) Patent No.: US 6,170,476 B1
(45) Date of Patent: Jan. 9, 2001

(54) INTERNAL SENSING PASSAGE IN AN EXHAUST GAS RECIRCULATION MODULE

(75) Inventors: John E. Cook, Chatham (CA); Murray F. Busato, Clinton Township, MI (US)

(73) Assignee: Siemens Canada Ltd., Mississauga (CA)

( * ) Notice: Under 35 U.S.C. 154(b), the term of this patent shall be extended for 0 days.

(21) Appl. No.: 09/199,182

(22) Filed: Nov. 25, 1998

Related U.S. Application Data

(60) Provisional application No. 60/086,680, filed on May 26, 1998.

(51) Int. Cl.[7] ..... F02M 25/07

(52) U.S. Cl. ..... 123/568.27

(58) Field of Search ..... 123/568.11, 568.21, 123/568.26, 568.27, 568.28, 569.29; 137/907

(56) References Cited

U.S. PATENT DOCUMENTS

| | | | | |
|---|---|---|---|---|
| 3,880,129 | | 4/1975 | Hollis, Jr. | 123/568.29 |
| 4,142,493 | | 3/1979 | Schira et al. | 123/568.21 |
| 4,173,205 | | 11/1979 | Toelle | 123/568.22 |
| 4,195,605 | | 4/1980 | Weathers et al. | 123/568.29 |
| 4,231,340 | * | 11/1980 | Nishimiya et al. | 123/568.27 |
| 4,256,076 | | 3/1981 | Bradshaw | 123/568.29 |
| 4,349,003 | | 9/1982 | Masuda | 123/568.29 |
| 4,351,285 | | 9/1982 | Bradshaw | 123/568.29 |
| 4,364,368 | | 12/1982 | Blanchette | 123/568.29 |
| 4,455,987 | | 6/1984 | Sübeck et al. | 123/568.27 |
| 4,469,079 | * | 9/1984 | Cook | 123/568.27 |
| 4,497,335 | | 2/1985 | Masuda | 137/244 |
| 4,566,423 | * | 1/1986 | Kenny et al. | 123/568.27 |
| 4,694,812 | | 9/1987 | Wendt | 123/568.27 |
| 5,188,086 | * | 2/1993 | Adkins et al. | 123/568.27 |
| 5,203,313 | * | 4/1993 | Rotarius | 123/568.27 |
| 5,241,940 | * | 9/1993 | Gates, Jr. | 123/568.27 |
| 5,448,981 | | 9/1995 | Cook et al. | 123/520 |
| 5,494,255 | | 2/1996 | Pearson et al. | 251/129.15 |
| 5,613,479 | * | 3/1997 | Gates et al. | 123/568.27 |
| 5,669,364 | | 9/1997 | Everingham | 123/568 |
| 5,901,690 | | 5/1999 | Hussey et al. | 123/568.26 |
| 5,960,776 | | 10/1999 | Everingham et al. | 123/568.26 |

FOREIGN PATENT DOCUMENTS

| | | |
|---|---|---|
| 195 00 565 A1 | 11/1995 | (DE) . |
| 0 496 487 A1 | 1/1992 | (EP) . |
| 0 840 001 A2 | 10/1997 | (EP) . |

* cited by examiner

*Primary Examiner*—Willis R. Wolfe

(57) ABSTRACT

An electric EGR module has a main flow passage containing a valve member operated by a movable actuator wall of a fluid pressure actuator to control exhaust gas flow through the passage. The movable actuator wall bounds a portion of a variable volume chamber space to which regulated vacuum from an electric vacuum regulator (EVR) valve is communicated to position the movable actuator wall, and hence the valve member. An internal pressure sensing passage, which includes a tube that also functions as a shaft for coupling motion of the actuator wall to the valve member, communicates pressure at one side of an orifice in the main flow passage to a pressure sensor. The tube communicates with a variable volume chamber space that forms a portion of the sensing passage and that varies in volume with the positioning of the tube by the actuator wall. The pressure sensor and the EVR valve are integrated with the body of the fluid pressure actuator.

22 Claims, 6 Drawing Sheets

INTERNAL SENSING PASSAGE IN AN EXHAUST GAS RECIRCULATION MODULE

REFERENCE TO RELATED APPLICATION AND PRIORITY CLAIM

This application expressly claims the benefit of earlier filing date and right of priority from the following patent application: U.S. Provisional Application Ser. No. 60/086,680, filed on May 26, 1998 in the names of John E. Cook and Murray F. Busato and entitled "Integrated Exhaust Gas Recirculation System". The entirety of that earlier-filed, co-pending patent application is hereby expressly incorporated herein by reference.

FIELD OF THE INVENTION

This invention relates generally to automotive emission control valves, such as exhaust gas recirculation (EGR) valves that are used in exhaust emission control systems of automotive vehicle internal combustion engines. More specifically, the invention relates to the integration of a sensor, a fluid pressure regulator valve, and a fluid-pressure-operated actuator in an EGR valve to create an EGR module, hereinafter sometimes referred to as a "Modular EGR".

BACKGROUND OF THE INVENTION

U.S. Pat. Nos. 5,241,940 (Gates, Jr.) and 5,613,479 (Gates et al.), which are hereby incorporated by reference, disclose EGR systems of the type in which a module that embodies principles of the present invention is useful.

SUMMARY OF THE INVENTION

The inventive module possesses a novel construction that provides important economic and functional advantages relating to fabrication, assembly, testing, installation, and use.

One generic aspect of the invention relates to an automotive emission control module comprising: an emission control valve body having an internal main flow passage between a first port and a second port, a valve for selectively restricting flow between the ports, an actuator for operating the valve, a pressure sensor having first and second pressure sensing ports, and first and second pressure sensing passages communicating the first and second pressure sensing ports to the main flow passage for sensing pressure differential along a portion of the length of the flow passage, the second pressure sensing passage extending through the actuator and comprising a chamber space that is disposed between the actuator and the pressure sensor.

Within this one generic aspect, some of the more specific aspects relate to the actuator comprising a shaft for operating the valve and an actuator body that contains two chamber spaces separated by a movable actuator wall that operates the shaft; the actuator body mounting on the emission control valve body, and the chamber space being arranged in axial succession along an axis of the module beyond the actuator relative to the valve; a separator wall separating the chamber space from the actuator, wherein the separator wall comprises an annulus having an inner margin sealed to an outside diameter of the shaft and an outer margin sealed to the actuator body; the inner margin of the separator wall annulus moving with the shaft; the actuator comprising a movable actuator wall dividing the actuator into two variable volume chamber spaces, and a spring being disposed within one of the two actuator chamber spaces to urge the valve toward closing the main flow passage; the actuator comprising an actuator body that mounts on the emission control valve body, and the second pressure sensing passage being internal to both the emission control valve body and the actuator body; including an orifice disposed in the main flow path between the first port and the valve for creating pressure differential between the first and second pressure sensing passages, and in which the first pressure sensing passage comprises a hole that extends through a wall of the emission control valve body circumscribing a location in the main flow passage that is between the first port and the orifice, and further including a tube extending from the hole external to the emission control valve body.

Still more of these more specific aspects relate to: the inclusion of a pressure regulating valve that comprises a source pressure port and a regulated pressure port and that, in accordance with a regulation signal, modulates source pressure at the source pressure port to a regulated pressure at the regulated pressure port, and in which the first pressure sensing passage communicates the first port to the source pressure port of the pressure regulating valve, and the regulated pressure port of the pressure regulating valve communicates with the actuator; the actuator comprising a shaft for operating the valve and two chamber spaces separated by a movable actuator wall that operates the shaft, the regulated pressure port of the pressure regulating valve communicating with one of the two chamber spaces of the actuator, and the other chamber space of the actuator communicating with atmosphere; the second pressure sensing passage comprising a chamber space arranged in axial succession with the actuator chamber spaces along an axis of the module, and the chamber space of the second pressure sensing passage being disposed axially beyond the two actuator chamber spaces relative to the valve; a separator wall dividing the chamber space of the second pressure sensing passage from the one chamber space of the actuator and comprising an annulus having an inner margin sealed to an outside diameter of the shaft and an outer margin sealed to a body of the actuator; the inclusion of an orifice disposed in the main flow path between the first port and the valve for creating pressure differential between the first and second pressure sensing passages, and in which the shaft comprises a tube, the valve comprises a stem extending from a head, one end of the tube is telescopically engaged with a free end of the stem, and the chamber space communicates via the tube and the stem with a location in the main flow passage that is between the first port and the orifice; and the chamber space communicating with the location in the main flow passage that is between the first port and the orifice via an opening in a side wall of the tube that is unoccluded by the telescopic engagement of the one tube end with the free end of the stem.

A further generic aspect relates to an automotive emission control module comprising: an emission control valve body having an internal main flow passage, a valve for selectively restricting the flow passage, an actuator comprising an actuator mechanism for operating the valve, a pressure sensor that provides a signal related to pressure communicated to the pressure sensor, and a pressure sensing passage communicating pressure to the pressure sensor from a location in the main flow passage, the pressure sensing passage including a variable volume chamber space which is external to the actuator mechanism, and the volume of which varies with the operation of the valve by the actuator mechanism.

Within this further generic aspect, more specific aspects relate to: the actuator mechanism comprising two chamber spaces separated by a movable actuator wall that operates the valve, and all three chamber spaces being disposed in axial succession along an axis of the module; the variable volume chamber space being disposed axially beyond the two chamber spaces of the actuator mechanism relative to the valve; the actuator mechanism comprising a movable actuator wall that divides the two chamber spaces of the actuator mechanism and that operates the valve via a tube which forms a portion of the pressure sensing passage; a spring being disposed within one of the chamber spaces of the actuator mechanism and acting on the movable actuator wall to urge the valve head toward seating on a valve seat; and a movable separator wall divides the variable volume chamber space from one of the two chamber spaces of the actuator mechanism and comprises an annulus having an inner margin sealed to an outside diameter of the tube and an outer margin sealed to a body of the actuator that contains the actuator mechanism.

Still another generic aspect relates to an automotive emission control module comprising: an emission control valve body having an internal main flow passage between a first port and a second port, a valve for selectively restricting the flow passage, an actuator, comprising an actuator body mounted on the emission control valve body, for operating the valve, an electric pressure sensor mounted on the actuator body and having a pressure sensing port ported to the main flow passage, an electric-operated fluid pressure regulator valve mounted on the actuator body for providing regulated fluid pressure to operate the actuator, one of the pressure sensor and the actuator body comprising a nipple that is telescopically received in a hole in the other of the pressure sensor and the actuator body to form a portion of a pressure sensing passage through which the pressure sensing port is ported to the main flow passage, the actuator comprising a shaft that is positionable along an axis to operate the valve, and the hole and nipple are coaxial with the axis. A more specific aspect relates to the pressure sensing passage comprising a chamber space separated from the actuator by a movable separator wall that moves with the shaft, the pressure sensing passage including a hole extending through the shaft providing communication between the chamber space and the main flow passage, and the nipple providing communication of the chamber space to the pressure sensing port of the sensor.

BRIEF DESCRIPTION OF THE DRAWINGS

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
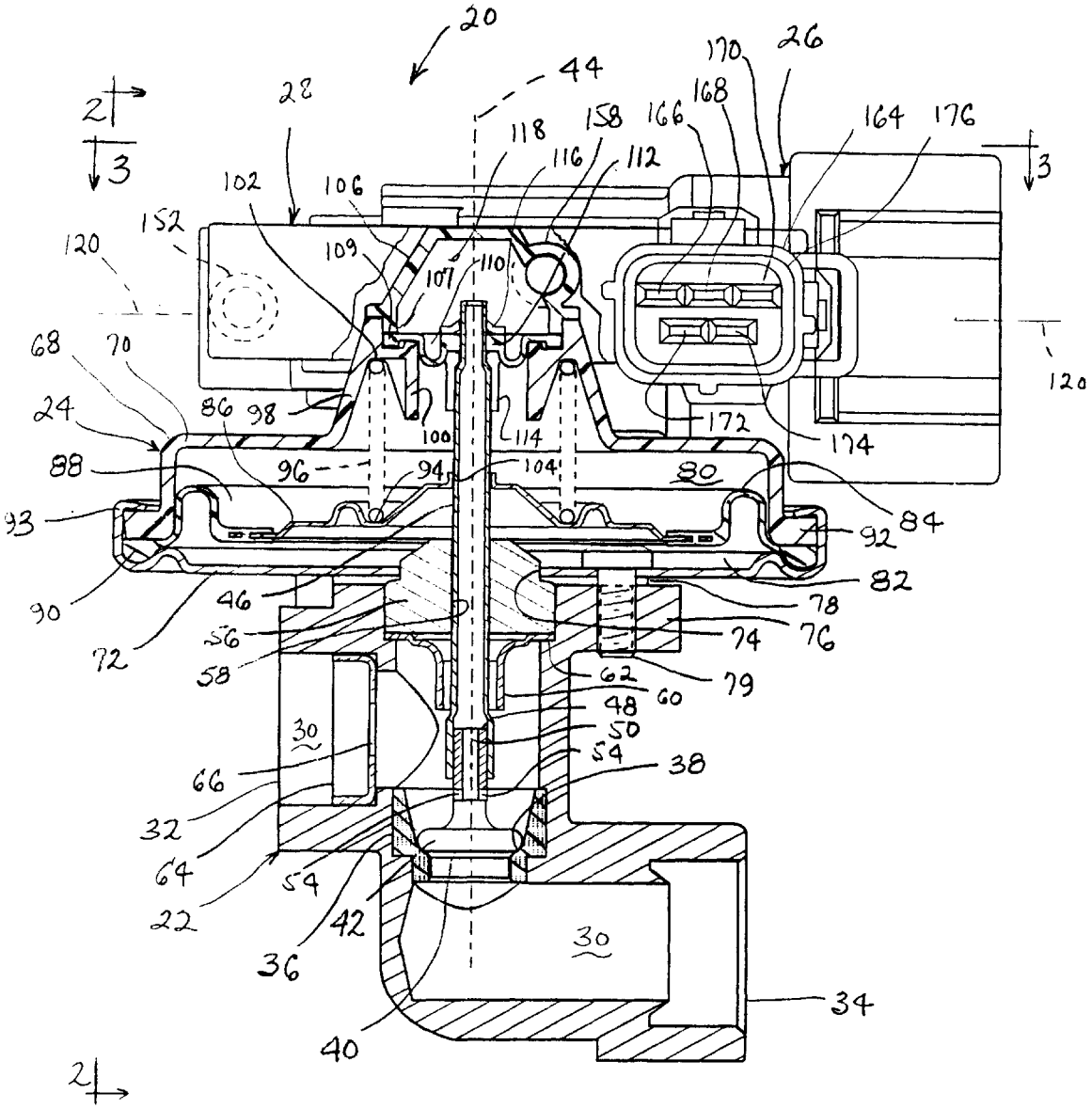
FIG. 1 is a front elevation view, partly in cross section, of an exemplary module embodying principles of the present invention.
Figure 2:
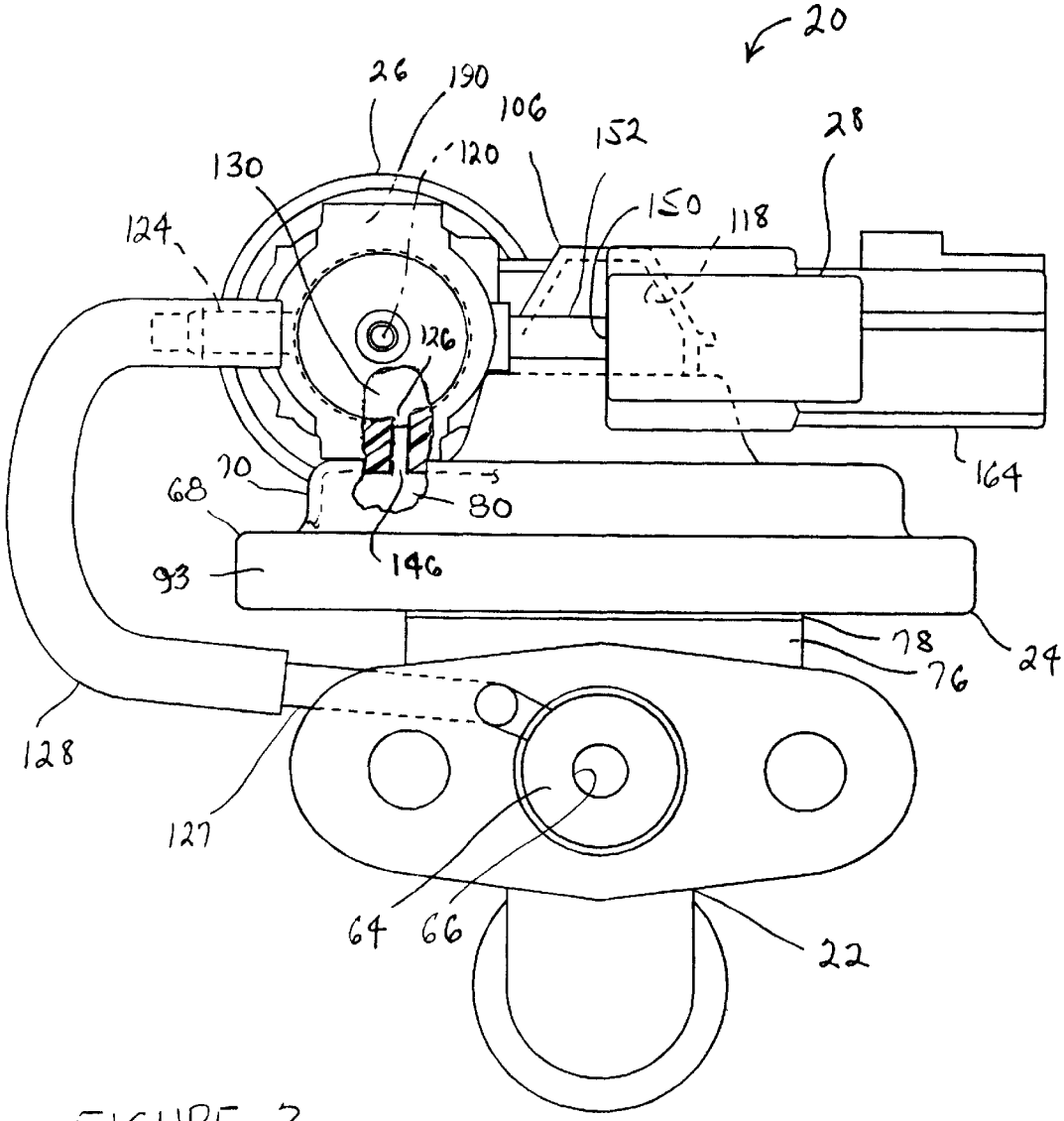
FIG. 2 is a full left side view in the direction of arrows 2—2 in FIG. 1.
Figure 3:
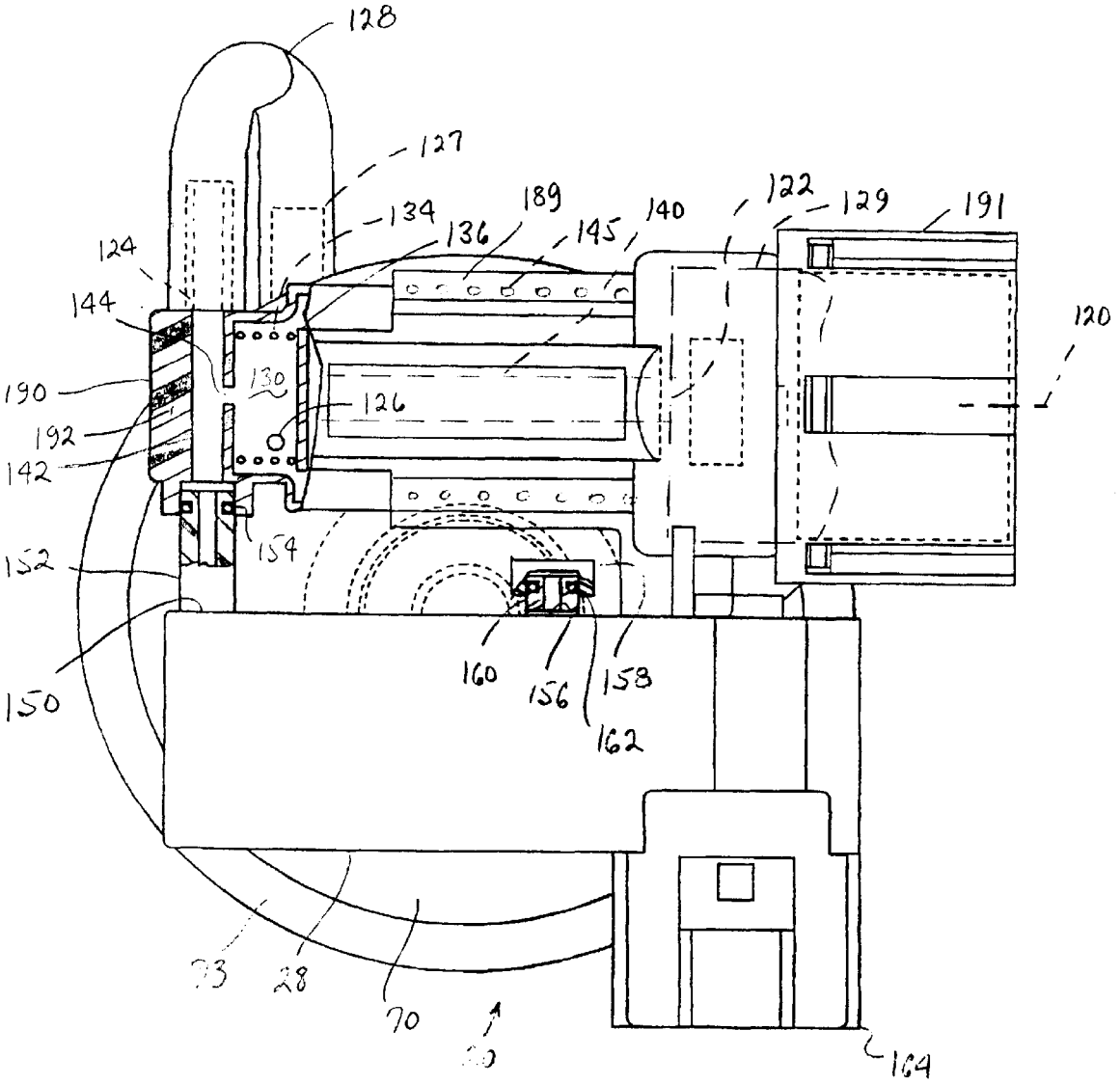
FIG. 3 is a full top plan view in the direction of arrows 3—3 in FIG. 1.

FIGS. 1–3 disclose a module 20 embodying principles of the invention and comprising an emission control valve body 22, a fluid-pressure-operated actuator 24, an electric-operated pressure regulator valve 26, and a sensor 28. Because incorporation of the inventive module 20 in EGR systems as described in the aforementioned "Gates" patents involves the use of engine induction system vacuum, i.e. negative pressure, valve 26 is an electric-operated vacuum regulator valve, sometimes referred to as an EVR valve, and sensor 28 is a pressure sensor that provides an electric signal related to the magnitude of sensed vacuum.

Valve body 22 comprises an internal main flow passage 30 extending between a first port 32 and a second port 34. An annular valve seat element 36 is disposed in valve body 22 to provide an annular seat surface 38 circumscribing a transverse cross-sectional area of passage 30. A valve member 40 comprising a non-flow-through valve head 42 is disposed within body 22 coaxially with an imaginary axis 44. Valve head 42 is shown seated on seat surface 38 closing passage 30 to flow between ports 32 and 34.

A hollow tube 46 is disposed coaxially with axis 44. One end of tube 46 is diametrically enlarged to telescopically overlap and join with a stem 48 of valve member 40 so that tube 46 functions as a shaft for operating valve member 40. Stem 48 comprises a central axial blind hole 50 and several radial holes 54 intersecting hole 50 to provide for the interior of tube 46 to communicate with passage 30. A bushing 56 is fitted to valve body 22 and comprises a central through-hole 58 providing axial guidance for motion of tube 46 along axis 44. Bushing 56 also captures the outer margin of a circular flange of a generally cylindrical walled metal shield 60 on an internal shoulder 62 of valve body 22. Shield 60 surrounds a portion of tube 46 that protrudes from through-hole 58. An orifice member 64 comprising an orifice 66 is wedged within passage 30 between port 32 and seat element 36 such that flow through main passage 30 is constrained to pass through orifice 66.

Fluid-pressure-operated actuator 24 comprises a body 68 that is in assembly with valve body 22 coaxial with axis 44. Actuator body 68 comprises a first body part 70 and a second body part 72. Body part 72 comprises sheet metal formed to a generally circular shape having a central through-hole 74 that allows the part to fit over an end of bushing 56 that protrudes beyond a flange 76 of body 22. An annular gasket 78 is sandwiched between body part 72 and flange 76. Each of body part 72, gasket 78, and flange 76 contains a like hole pattern that provides for the secure attachment of body part 72 to valve body 22 by headed screws 79 whose threaded shanks are passed through aligned holes in part 72 and gasket 78 and tightened in threaded holes in flange 76.

Body 68 comprises an interior that is divided into two chamber spaces 80, 82 by a movable actuator wall 84. Movable actuator wall 84 comprises an inner formed metal part 86 and an outer flexible part 88. Part 88 has a circular annular shape including a convolution 88*c* that rolls as wall 84 moves. Part 88 also has a bead 90 extending continuously around its outer margin. The outer margin of actuator body part 70 comprises a shoulder 92, and bead 90 is held compressed between parts 70 and 72 by an outer margin 93 of body part 72 being folded around and crimped against shoulder 92, thereby securing parts 70, 72, and 88 in assembly and sealing the outer perimeters of chamber spaces 80 and 82. The inner margin of part 88 is insert-molded onto the outer margin of part 86 to create a fluid-tight joint uniting the two parts.

Part 86 is constructed to provide a seat 94 for seating an axial end of a helical coil compression spring 96 that is disposed within chamber space 80. Body part 70 comprises a central tower 98 proximate the end of which is an integral circular wall 100 that provides an internal circular groove 102 for seating the opposite end of spring 96. In this way spring 96 acts to bias movable wall 84 axially toward valve seat surface 38. Part 86 further comprises a central flanged hole 104 through which tube 46 passes and to which tube 46 has fluid-tight attachment. Accordingly, the biasing of wall 84 by spring 96 acts via tube 46 to urge valve head 42 toward seating on seat surface 38, and thereby closing passage 30 to flow between ports 32 and 34.

The actuator body further includes a cap 106 that is mounted atop tower 98 to close the otherwise open end of part 70. Cap 106 is in assembly with part 70 and comprises a rim 107 that forces a sealing bead 109 of a movable separator wall 110 against wall 100. Wall 110 is a flexible part having bead 109 extending around its outer margin, a bead 112 around its inner margin, and a rolling convolution between its inner and outer margins. Bead 112 is held fluid-tight on tube 46 between a sleeve 114 that is fitted onto tube 46 below bead 112 and a washer 116 that is fitted onto tube 46 above the bead. Cap 106 and wall 110 thereby cooperatively define a third chamber space 118 that is consecutive along axis 44 to chamber spaces 80 and 82 and separated from chamber space 80 by wall 110. The end of tube 46 disposed within chamber space 118 is open, thereby placing the interior of the former in communication with the latter. Because the convolution of separator wall 110 rolls as the central region of the wall is moved by tube 46, the volume of chamber space 118 varies with the movement imparted to tube 46 by actuator 24.

EVR valve 26 has an imaginary longitudinal axis 120 that is disposed orthogonal to a plane containing axis 44. Valve 26 comprises an atmospheric inlet port 122 for communication to atmosphere, a source vacuum inlet port 124 for communication to engine intake system vacuum, and a regulated vacuum outlet port 126. Because port 30 is communicated to intake system vacuum when, module 20 is in use, that vacuum can be conveniently communicated to port 124 by a tap 127 into body 22 immediately adjacent port 30 before orifice 66 and a C-shaped hose 128 having one end fitted over an exterior end of tap 127 and another end fitted over a nipple that forms source vacuum inlet port 124 in the illustrated embodiment.

EVR valve 26 comprises an enclosure, or body, 190 having a cylindrical side wall 189 and containing an internal regulating mechanism like that of the EVR valves described in U.S. Pat. No. 5,448,981, which is incorporated herein by reference. Atmospheric inlet port 122 communicates to atmosphere through a particulate filter 129 contained within an interior space at one axial end of enclosure 190. Enclosure 190 comprises an end cap 191 fitted over filter 129 at that one axial end. Within an opposite axial end of the enclosure is a regulated vacuum chamber space 130. A helical coil compression spring 134 is disposed within chamber space 130 to bias a valve disk 136 toward seating on a valve seat 138 at an end of a passage 140 that is coaxial with axis 120 and leads to atmospheric port 122. When seated, valve disk 136 closes passage 140, blocking communication between chamber space 130 and atmosphere.

Proximately adjacent chamber space 130, an end wall 192 of enclosure 190 contains a passageway 142 that is transverse to axis 120 and forms a continuation of the passage through the nipple forming port 124. Communication between chamber space 130 and passageway 142 is through an orifice 144 that is integrally formed in end wall 190 coaxial with axis 120.

The internal mechanism of EVR valve 26 further comprises a solenoid 145 that is operated by pulse width modulation. The pulse width modulation of the solenoid modulates disk 136 to correspondingly modulate the bleeding of vacuum from chamber space 130 and through passage 140 to atmosphere. A pulse width modulated electric signal applied to solenoid 145 causes the vacuum in chamber space 130 to be regulated in accordance with the degree of signal modulation within a range that extends essentially from full intake system vacuum applied at vacuum inlet port 124 to essentially atmospheric pressure applied at atmospheric inlet port 122.

A further internal passage 146 extends from regulated vacuum outlet port 126 to actuator chamber space 80 to place the latter in fluid communication with chamber space 130. In this way, the vacuum in chamber space 80 is regulated in accordance with the pulse-width-modulated electric signal that operates valve 26.

Passageway 142 also serves to pass intake system vacuum to a pressure sensing port 150 of sensor 28. This is accomplished through a tube 152 extending between port 150 and a location on EVR valve 26 diametrically opposite the nipple forming port 124. Tube 152 may be embodied as part of the body of sensor 28, fitting into a counterbore in EVR valve 26 at the end of passage 172. The end portion of tube 152 comprises an 0-ring 154 seated in an external circular groove to provide a fluid-tight radial seal of the tube's O.D. to the I.D. of the counterbore.

Sensor 28 comprises a second pressure sensing port 156 that is communicated to chamber space 118. A frustoconical shaped wall of cap 106 contains a local formation 158 that provides a tap to chamber space 118. A tube 160, which like tube 152 may be embodied as a part of the pressure sensor body, is disposed to extend from the sensor body parallel to tube 152 for communicating port 156 with the tap into chamber space 118. The end portion of tube 160 comprises an O-ring 162 seated in an external circular groove to provide a fluid-tight radial seal of the tube's O.D. to the I.D. of a hole that extends through the wall of formation 158.

The organization and arrangement that has been described therefore provides first and second pressure sensing passages. The first pressure sensing passage extends from port 32 through tap 127, hose 128, passageway 142, and tube 152 to sensing port 150. The second pressure sensing passage extends from main flow passage 30 at a location between orifice 66 and valve seat 38, through stem 48 of valve member 40, through tube 46, through chamber space 118, through formation 158, and through tube 160 to sensing port 156. In this way sensor 28 can sense pressure differential across orifice 66.

An electric connector 164 provides for sensor 28 and EVR valve 26 to be connected with an electric control circuit (not shown). Connector 164 contains five one-piece, stamped metal, terminals, three of which, 166, 168, 170, are associated with sensor 28 and two of which, 172, 174, with EVR valve 26. Connector 164 comprises a surround 176 that forms part of the body of sensor 28. Surround 176 laterally bounds free ends of all five terminals 166, 168, 170, 172, 174. Terminals 166, 168, 170 extend into the sensor body from their free ends that are within surround 176 to connect to respective sensor element leads. Terminals 172, 174 extend through the sensor body from the free ends that are within surround 176 to opposite free ends arranged in a fixed terminal end pattern. There they make mating connection with similarly arranged terminal ends of terminals of EVR valve 26 upon assembly of sensor 28 and valve 26 together. Such assembly comprises aligning tube 152 with hole 154, aligning tube 160 with hole 162, and aligning terminals of EVR valve 26 with corresponding terminals carried by sensor 28, and then advancing the sensor and EVR valve toward each other.

Hence, when connector 164 is connected with a mating connector (not shown) of electric circuitry that operates module 20, electric terminals 172, 174 carry pulse width modulated current to solenoid 145, and terminals 166, 168, 170 carry electric current signals related to pressures sensed at sensor ports 150, 156.

An important aspect of the integration of EVR valve 26 and actuator 24 in module 20 relates to fabricating enclosure 190 and actuator body part 70 as a single polymeric part. Side wall 189 and end wall 192 of enclosure 190, and actuator body part 70, are embodied in a single polymeric part which includes internal passage 146 extending from regulated vacuum outlet port 126 to actuator chamber space 80 to place the latter in fluid communication with chamber space 130 so that vacuum in chamber space 80 is regulated in accordance with the pulse-width-modulated electric signal that operates valve 26.

Figure 4:
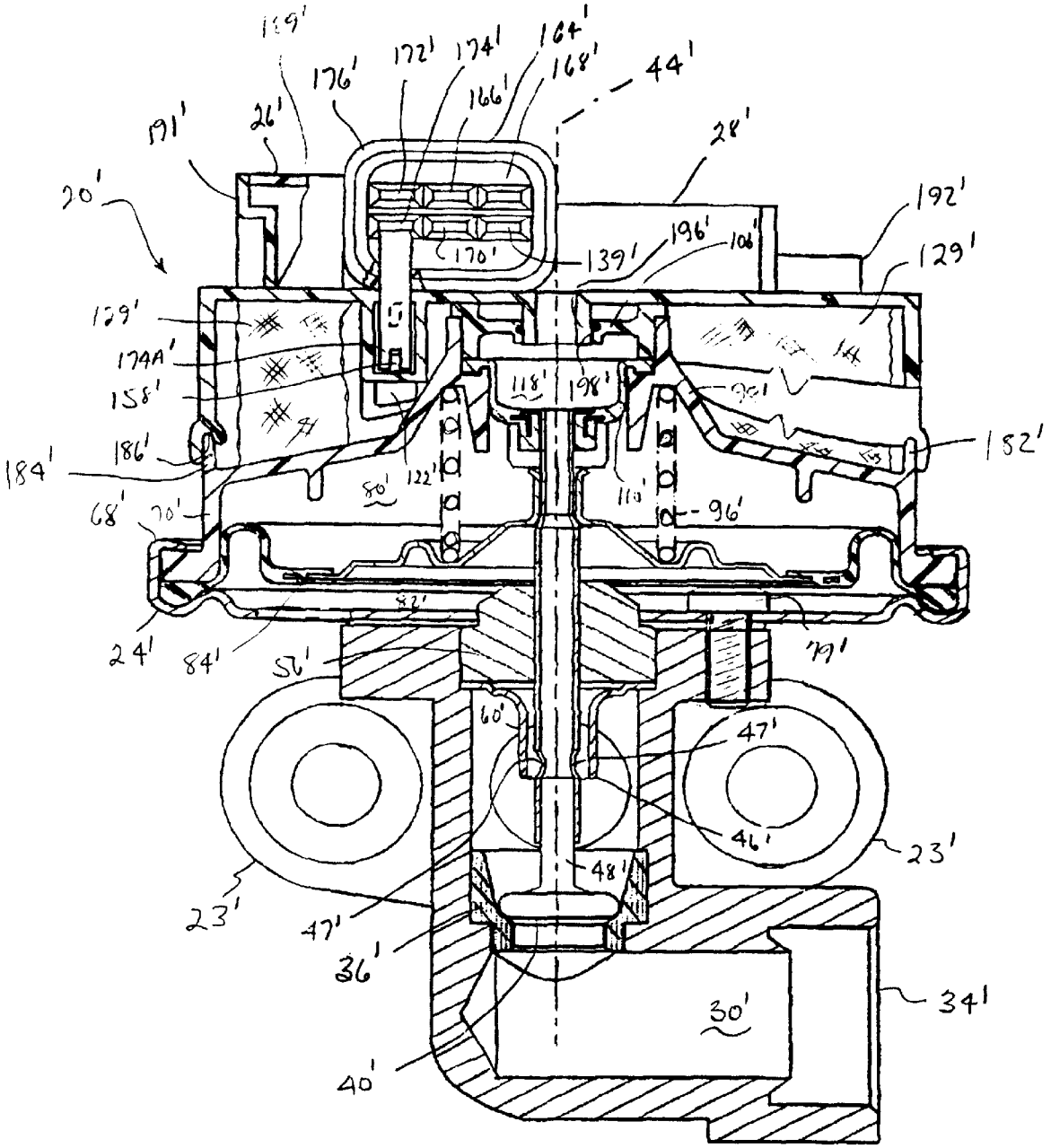
FIG. 4 is view similar to FIG. 1 showing a second exemplary module embodying principles of the present invention.
Figure 5:
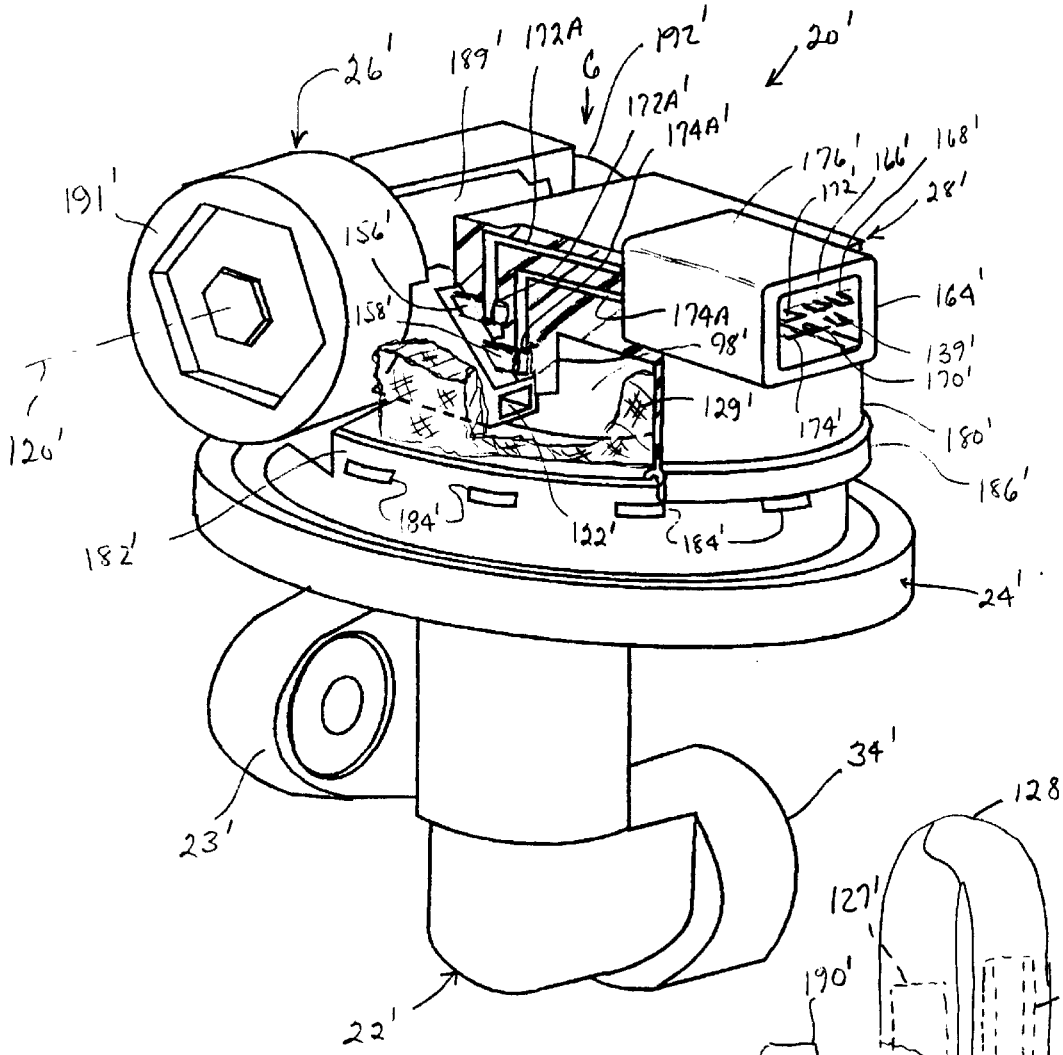
FIG. 5 is a perspective view, partly broken away, of the FIG. 4 embodiment.
Figure 6:
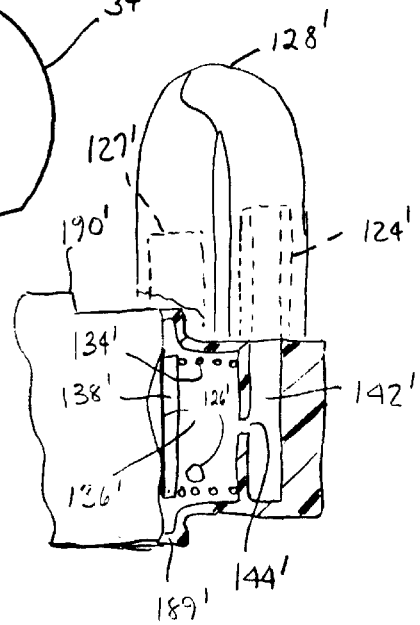
FIG. 6 is a fragmentary view looking in the general direction of arrow 6 in FIG. 5 with portions sectioned away.

FIGS. 4, 5, and 6 show an embodiment of valve 20' in which component parts corresponding to parts of valve 20 already described are identified by like reference numerals. While the general organization and arrangement of valve 20' is like that of valve 20, several prime-numbered parts, including the following, differ in certain details from their unprime-numbered counterparts: actuator body part 70'; EVR valve 26'; pressure sensor 28'; electric connector 164'; cap 106'; valve member 40'; tube 46'; movable actuator wall 84'; and movable separator wall 110', for examples.

EVR valve 26' has its atmospheric inlet port 122' open to a somewhat semi-circularly shaped space that is enclosed by filter 129' and by the mounting of sensor 28' on actuator 24'. Filter 129' is also enclosed by the mounting of sensor 28' and has a somewhat semi-circular shape that surrounds the open space to which atmospheric inlet port 122' is communicated. The body of sensor 28' includes a somewhat semi-circular shaped skirt 180' that provides a downright side wall spaced slightly outwardly of a somewhat semicircular outer surface of filter 129'. Actuator body part 70' has an upright rim 182' that contains a series of through-holes 184'. Air can enter via these through-holes to the space between the inside wall surface of skirt 180' and the radially outer surface of filter 129'. In this way, the semi-circular circumferential extent of filter 129' about axis 44' provides an ample surface area for filtration of air without significant restriction before the air can enter port 122'. The filter is preferably constructed to minimize pressure drop across it and to distribute the airstream passing through it as uniformly as possible so as to avoid the creation of "hot spots".

The lower edge of skirt 180' has a groove 186' that fits onto the upper edge of rim 182' when the skirt and rim are in assembly relationship. From the base of tower 98', the wall of part 70' declines toward through-holes 184' to provide a declined surface for gravity drainage of any liquid that may accumulate within space enclosed by the mounting of sensor 28' on actuator 24'. Filter 129' and skirt 180' have a circumferential co-extent that is circular for less than 360° about axis 44'. Beyond this approximately semi-circular co-extent, both the filter and the body of sensor 28' are shaped to fit to external surfaces of actuator body part 70' and/or EVR valve enclosure 190' in fluid-tight manner that may include a suitable seal. For example, from generally diametrically opposite ends of its semi-circular extent, the skirt may continue more or less chordally relative to axis 44' so as to lie in a plane generally parallel to axis 120' and for the most part close against actuator body part 70' except for a notch that fits onto a projecting portion of the EVR enclosure that projects away from axis 120' and contains electric terminals 156' and 158' and port 122'.

The body of sensor 28' serves purposes that are additional to the purpose of forming a cover that fits onto the actuator. It houses pressure sensing elements that supply electric signals related to pressures sensed at its ports; it also integrates electric connector 164'. Four terminals 166', 168', 170', and 139' of connector 164' extend within the sensor body from a surround 176' to make electric connections with respective leads of sensor elements of sensor 28'. Two terminals 172', 174' of connector 164' have right-angle shapes and extend within the sensor body from surround 176' to terminate in forked ends 172A', 174A' that make connection to respective blade terminals 156', 158' that are part of EVR valve 26'. Hence, electric connections for both EVR valve 26' and pressure sensor 28' are embodied in a single connector 164'.

Like actuator body part 70 and wall portions 189, 192 of enclosure 190, actuator body part 70' and wall portions 189', 192' of EVR valve 26' are embodied in a single part of homogeneous material throughout, such as a polymeric (plastic) part fabricated by injection molding. Internal mechanism of valve 26' is assembled into enclosure 190' through an opening at the opposite axial end of side wall 189' which is thereafter closed by an end cap 191'. The single polymeric part that integrates enclosure 190' and actuator body part 70' also contains an internal passage 146' that communicates regulated vacuum port 126' of EVR valve 26' to chamber space 80' of actuator 24'. Intake system vacuum is communicated through tap 127' and hose 128' to a vacuum inlet port 124' in end wall 192' centered on axis 120'. Within enclosure 190' just inside end wall 192' is an arrangement that is analogous to that described for module 20. That arrangement is shown in FIG. 6.

The integration of various parts with pressure sensor 28' provides a unit that is assembled to body 68' of actuator 24'. Such assembly comprises aligning that unit with the exterior of part 70', and then advancing the unit to essentially concurrently seat groove 186' on the edge of rim 182', lodge the end of a nipple 196' into sealed fit with an O-ring-containing hole 198' in cap 106', and engage the forked ends 172A', 174A' of terminals 172', 174' with blade terminals 156', 158'.

A further difference in module 20' is that stem 48' contains no portion of the sensing passage that extends through the interior of tube 46'. Just beyond the end of stem 48' the side wall of tube 46' has several through-holes 47' that communicate the interior of the tube to main passage 30'. Shield 60' axially overlaps these through-holes for all operating positions of tube 46'.

Figure 7:
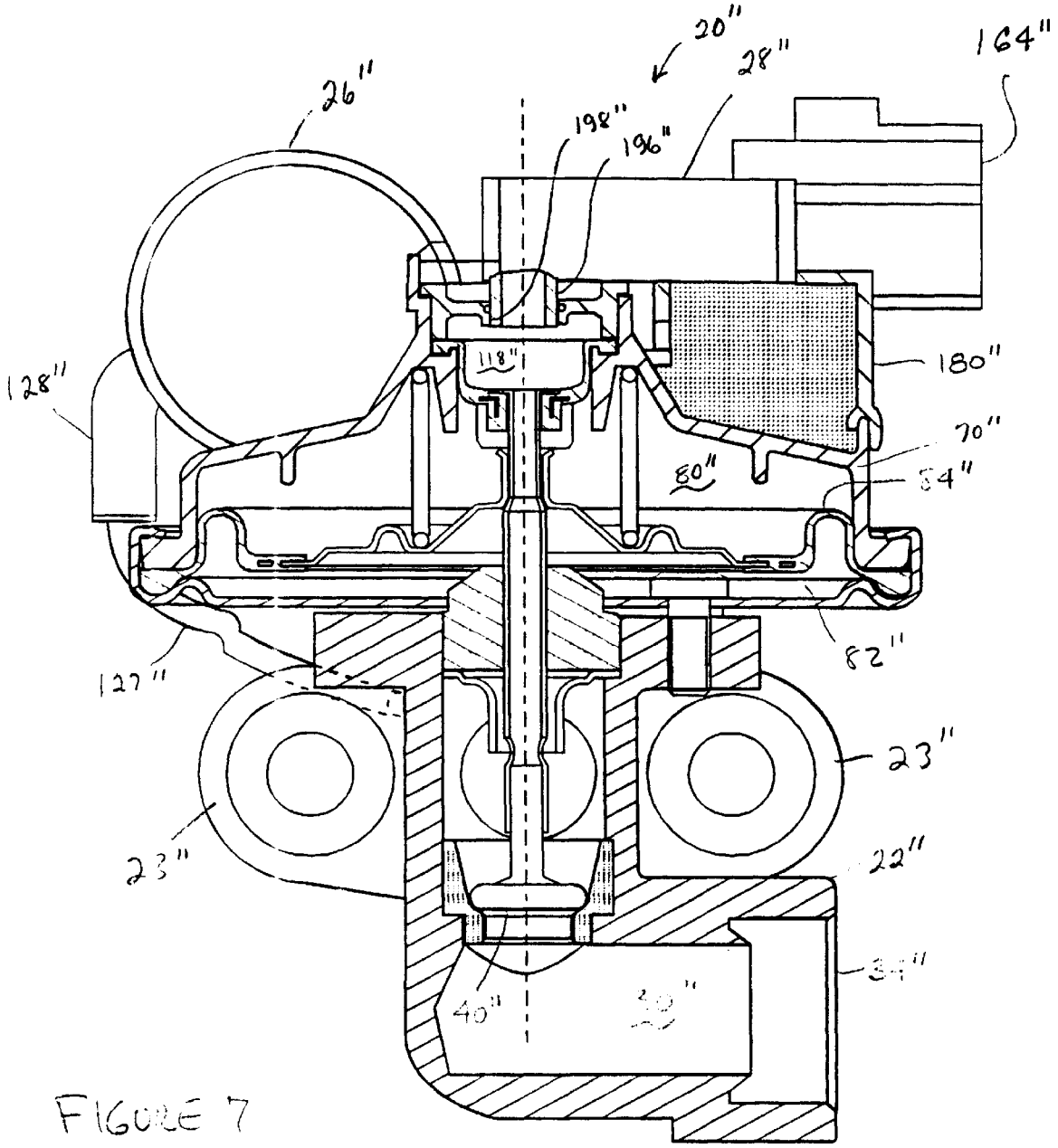
FIG. 7 is a view similar to FIG. 1 showing a third exemplary module embodying principles of the present invention.

FIG. 7 discloses an embodiment of module 20" in which component parts corresponding to parts of module 20' are identified by like reference numerals, except double primed. The general organization and arrangement of module 20" is like that of module 20', except that actuator 24" and those parts mounted on actuator body part 70" are disposed 90° about axis 44" from the disposition in module 20', and the tap for supplying intake system vacuum to port 32" has been relocated.

In use of any of EGR modules 20, 20', and 20", port 34, 34', 34" is communicated to engine exhaust gas and port 32, 32', 32" to engine intake system vacuum, such as intake manifold vacuum. For mounting of any of the valves, valve body 22, 22', 22" may include a respective mounting flange 23, 23', 23" that contains multiple holes for fastening the valve by means of fasteners.

Each of valves 20, 20', and 20" may function in the manner described in either of the above referenced U.S. Pat. Nos. 5,241,940 (Gates, Jr.) and 5,613,479 (Gates et al.). Briefly, control of exhaust gas flow through main passage 30, 30', 30" is accomplished by operating the EVR valve 26, 26', 26" to cause the pressure differential across movable actuator wall 84, 84', 84" to position valve head 40, 40', 40" to regulate the pressure differential across orifice 66, 66', 66" in a desired manner for particular engine operating conditions. Chamber space 82, 82', 82" is communicated to atmosphere, such as by one or more openings through the wall of part 72, 72', 72" adjacent flange 23, 23', 23". Because orifice 66, 66', 66" possesses an inherent pressure drop vs. flow characteristic, control of the pressure differential across it will inherently control flow through the EGR valve.

The disclosed EGR valves are advantageous for a number of reasons. Because sensing of pressure between a valve seat surface 38, 38', and 38" and a respective orifice 66, 66', and 66" occurs internally of the EGR valve, no external passage for such sensing is required. It is believed that the integration of various of parts with sensor 28, 28', 28" and with actuator body part 70, 70' and 70" can provide significant advantages in fabrication, assembly, and testing procedures. Such integration comprises various possibilities additional to those already mentioned.

Any of the EVR valve enclosure, the pressure sensor body, and the fluid pressure actuator body may be a piece that is fabricated by itself, and subsequently assembled to the others. Such assembly steps may comprises the use of separate and/or integrated fastening devices. Examples of separate fastening devices include devices such as screws and rivets. Examples of integrated fastening devices include tongue and groove connections, press-fit connections, and snap-catches.

The method of fabrication of modules 20, 20', and 20" is the subject of co-pending patent application Ser. No. 09/199,185, METHOD OF MAKING AN AUTOMOTIVE EMISSION CONTROL MODULE HAVING FLUID-POWER-OPERATED ACTUATOR, FLUID PRESSURE REGULATOR VALVE, AND SENSOR, pending, which is incorporated in entirety herein by reference. Various other inventive aspects may be found in the following commonly assigned, co-pending, non-provisional patent applications that are also incorporated in their entirety herein by reference: Ser. No. 09/199,183, INTEGRATION OF SENSOR, ACTUATOR, AND REGULATOR VALVE IN AN EMISSION CONTROL MODULE, pending; Ser. No. 09/199,184, CALIBRATION AND TESTING OF AN AUTOMOTIVE EMISSION CONTROL MODULE, pending; and Ser. No. 09/199,186, AUTOMOTIVE VEHICLE HAVING A NOVEL EXHAUST GAS RECIRCULATION MODULE, pending.

It is to be understood that because the invention may be practiced in various forms within the scope of the appended claims, certain specific words and phrases that may be used to describe a particular exemplary embodiment of the invention are not intended to necessarily limit the scope of the invention solely on account of such use.

What is claimed is:

1. An automotive emission control module, comprising:

an emission control valve body having an internal main flow passage between a first port and a second port, a valve for selectively restricting flow between the ports, an actuator for operating the valve, a pressure sensor having first and second pressure sensing ports, first and second pressure sensing passages communicating the first and second pressure sensing ports to the main flow passage for sensing pressure differential along a portion of the length of the flow passage, the second pressure sensing passage extending through the actuator and including a chamber space that is disposed between the actuator and the pressure sensor, an orifice disposed in the main flow path between the first port and the valve for creating pressure differential between the first and second pressure sensing passages, the first pressure sensing passage including a hole extending through a wall of the emission control valve body circumscribing a location in the main flow passage that is between the first port and the orifice, and a tube extending from the hole external to the emission control valve body.

2. An automotive emission control module, comprising:

an emission control valve body having an internal main flow passage between a first port and a second port, a valve for selectively restricting flow between the ports, an actuator for operating the valve, a pressure sensor having first and second pressure sensing ports, and first and second pressure sensing passages communicating the first and second pressure sensing ports to the main flow passage for sensing pressure differential along a portion of the length of the flow passage, the second pressure sensing passage extending through the actuator and comprising a chamber space that is disposed between the actuator and the pressure sensor, and an orifice disposed in the main flow path between the first port and the valve and creating a pressure differential between the first and second pressure sensing passages, the shaft including a tube, the valve including a stem extending from a head, and one end of the tube telescopically engaging a free end of the stem, and the chamber space communicating via the tube and the stem with a location in the main flow passage that is between the first port and the orifice.

3. An automotive emission control module, comprising:

an emission control valve body having an internal main flow passage between a first port and a second port, a valve for selectively restricting flow between the ports, an actuator for operating the valve, a pressure sensor having first and second pressure sensing ports, and first and second pressure sensing passages communicating the first and second pressure sensing ports to the main flow passage for sensing pressure differential along a portion of the length of the flow passage, the second pressure sensing passage extending through the actuator and comprising a chamber space that is disposed between the actuator and the pressure sensor, and an orifice disposed in the main flow path between the first port and the valve and creating a pressure differential between the first and second pressure sensing passages, the shaft comprising a tube, the valve member including a stem extending from a valve head, and one end of the tube telescopically engaging a free end of the stem, and the chamber space communicating with a location in the main flow passage that is between the first port and the orifice via an opening in a side wall of the tube that is unoccluded by the telescopic engagement of the one tube end with the free end of the stem.

4. An automotive emission control module comprising:

an emission control valve body having an internal main flow passage between a first port and a second port, a valve for selectively restricting the flow passage, an actuator, comprising an actuator body mounted on the emission control valve body, for operating the valve, an electric pressure sensor mounted on the actuator body and having a pressure sensing port ported to the main flow passage, an electric-operated fluid pressure regulator valve mounted on the actuator body for providing regulated fluid pressure to operate the actuator, one of the pressure sensor and the actuator body comprising a nipple that is telescopically received in a hole in the other of the pressure sensor and the actuator body to form a portion of a pressure sensing passage through which the pressure sensing port is ported to the main flow passage, the actuator comprising a shaft that is positionable along an axis to operate the valve, and the hole and nipple are coaxial with the axis.

5. An automotive emission control valve as set forth in claim 4 in which the pressure sensing passage comprises a chamber space separated from the actuator by a movable separator wall that moves with the shaft, the pressure sensing passage includes a hole extending through the shaft providing communication between the chamber space and the main flow passage, and the nipple provides communication of the chamber space to the pressure sensing port of the sensor.

6. An automotive emission control module, comprising:

an emission control valve body having an internal main flow passage between a first port and a second port, a valve for selectively restricting flow between the ports, an actuator including a shaft operatively connected to the valve and an actuator body defining two chamber spaces separated by a movable actuator wall operatively connected to the shaft, a pressure sensor having first and second pressure sensing ports, first and second pressure sensing passages communicating the first and second pressure sensing ports to the main flow passage for sensing pressure differential along a portion of the length of the flow passage, the second pressure sensing passage extending through the actuator and comprising a chamber space that is disposed between the actuator and the pressure sensor, and a separator wall separating the chamber space of the second pressure sensing passage from the actuator, the separator wall including an annulus having an inner margin sealed to an outside diameter of the shaft and an outer margin sealed to the actuator body.

7. An automotive emission control module as set forth in claim 1 in which the actuator body mounts on the emission control valve body, and the chamber space is arranged in axial succession along an axis of the module beyond the actuator relative to the valve.

8. An automotive emission control module as set forth in claim 1 in which the inner margin of the separator wall annulus moves with the shaft.

9. An automotive emission control module as set forth in claim 1 in which the actuator comprises a movable actuator wall dividing the actuator into two variable volume chamber spaces, and a spring is disposed within one of the two actuator chamber spaces to urge the valve toward closing the main flow passage.

10. An automotive emission control module as set forth in claim 1 in which the actuator comprises an actuator body that mounts on the emission control valve body, and the second pressure sensing passage is internal to both the emission control valve body and the actuator body.

11. An automotive emission control module, comprising:

an emission control valve body having an internal main flow passage between a first port and a second port, a valve for selectively restricting flow between the ports, an actuator for operating the valve, a pressure sensor having first and second pressure sensing ports, and first and second pressure sensing passages communicating the first and second pressure sensing ports to the main flow passage for sensing pressure differential along a portion of the length of the flow passage, the second pressure sensing passage extending through the actuator and comprising a chamber space that is disposed between the actuator and the pressure sensor, and a pressure regulating valve including a source pressure port and a regulated pressure port, the pressure regulating valve, in accordance with a regulation signal, modulating source pressure at the source pressure port to a regulated pressure at the regulated pressure port, the first pressure sensing passage communicating the first port to the source pressure port of the pressure regulating valve, and the regulated pressure port of the pressure regulating valve communicating with the actuator.

12. An automotive emission control module as set forth in claim 11 in which the actuator comprises a shaft for operating the valve and two chamber spaces separated by a movable actuator wall that operates the shaft, the regulated pressure port of the pressure regulating valve communicates with one of the two chamber spaces of the actuator, and the other chamber space of the actuator communicates with atmosphere.

13. An automotive emission control module as set forth in claim 12 in which the second pressure sensing passage comprises a chamber space arranged in axial succession with the actuator chamber spaces along an axis of the module, and the chamber space of the second pressure sensing passage is disposed axially beyond the two actuator chamber spaces relative to the valve.

14. An automotive emission control module as set forth in claim 13 in which a separator wall divides the chamber space of the second pressure sensing passage from the one chamber space of the actuator and comprises an annulus having an inner margin sealed to an outside diameter of the shaft and an outer margin sealed to a body of the actuator.

15. An automotive emission control module comprising:

an emission control valve body having an internal main flow passage, a valve for selectively restricting the flow passage, an actuator comprising an actuator mechanism for operating the valve, a pressure sensor that provides a signal related to pressure communicated to the pressure sensor, and a pressure sensing passage communicating pressure to the pressure sensor from a location in the main flow passage, the pressure sensing passage including a variable volume chamber space which is external to the actuator mechanism, and the volume of which varies with the operation of the valve by the actuator mechanism.

16. An automotive emission control module as set forth in claim 15 including a movable separator wall that divides the variable volume chamber space from the actuator mechanism.

17. An automotive emission control module as set forth in claim 15 in which the actuator mechanism comprises a tube that operates the valve and that forms a portion of the pressure sensing passage, and the movable wall comprises an annulus having an inner margin sealed to an outside diameter of the tube and an outer margin sealed to the valve body.

18. An automotive emission control module as set forth in claim 15 in which the actuator mechanism comprises two chamber spaces separated by a movable actuator wall that operates the valve, and all three chamber spaces are disposed in axial succession along an axis of the module.

19. An automotive emission control module as set forth in claim 18 in which the variable volume chamber space is disposed axially beyond the two chamber spaces of the actuator mechanism relative to the valve.

20. An automotive emission control module as set forth in claim 19 in which the actuator mechanism comprises a movable actuator wall that divides the two chamber spaces of the actuator mechanism and that operates the valve via a tube which forms a portion of the pressure sensing passage.

21. An automotive emission control module as set forth in claim 20 in which a spring is disposed within one of the chamber spaces of the actuator mechanism and acts on the movable actuator wall to urge the valve head toward seating on a valve seat.

22. An automotive emission control module as set forth in claim 20 in which a movable separator wall divides the variable volume chamber space from one of the two chamber spaces of the actuator mechanism and comprises an annulus having an inner margin sealed to an outside diameter of the tube and an outer margin sealed to a body of the actuator that contains the actuator mechanism.

* * * * *